US007597193B2

(12) United States Patent
Meynard

(10) Patent No.: US 7,597,193 B2
(45) Date of Patent: Oct. 6, 2009

(54) SHOE BOX DIVIDER

(76) Inventor: Michel Meynard, 310 Wellesley St., Weston, MA (US) 02493

( * ) Notice: Subject to any disclaimer, the term of this patent is extended or adjusted under 35 U.S.C. 154(b) by 433 days.

(21) Appl. No.: 11/189,499

(22) Filed: Jul. 26, 2005

(65) Prior Publication Data

US 2005/0258224 A1 Nov. 24, 2005

Related U.S. Application Data

(63) Continuation of application No. 10/131,313, filed on Apr. 24, 2002, now Pat. No. 6,951,277.

(51) Int. Cl.
*B65D 85/18* (2006.01)

(52) U.S. Cl. ..... 206/278; 229/120.13; 206/476

(58) Field of Classification Search ..... 229/120.28, 229/120.32, 120.15, 120.21, 169; 206/467, 206/489, 487, 493, 490, 278
See application file for complete search history.

(56) References Cited

U.S. PATENT DOCUMENTS

| | | | | | |
|---|---|---|---|---|---|
| 193,366 | A | * | 7/1877 | Dreyfus | 206/45.2 |
| 1,374,473 | A | * | 4/1921 | Scotcher | 229/117.05 |
| 1,700,432 | A | | 1/1929 | Cahill | |
| 1,764,251 | A | | 6/1930 | Farago | |
| 1,781,624 | A | | 11/1930 | Barnes | |
| 1,929,490 | A | * | 10/1933 | Golden | 206/772 |
| 2,104,828 | A | | 1/1938 | Brinnon | |
| 2,129,501 | A | | 9/1938 | Mann | |
| 2,333,643 | A | | 11/1943 | Donnelian | |
| 2,457,291 | A | | 12/1948 | Wenzel | |
| 2,621,738 | A | | 12/1952 | Buttery | |
| 2,709,518 | A | | 5/1955 | Justin | |
| 2,766,874 | A | * | 10/1956 | Borowick | 206/294 |
| 2,782,978 | A | | 2/1957 | Karr | |
| 2,834,460 | A | | 5/1958 | Lee | |
| 2,855,096 | A | | 10/1958 | Aull | |
| 3,360,112 | A | | 12/1967 | Johnson | |
| 3,361,324 | A | | 1/1968 | Crisafulli | |
| 3,397,772 | A | * | 8/1968 | Farquhar | 206/783 |
| 3,804,321 | A | | 4/1974 | Forbes, Jr. | |
| 3,942,707 | A | | 3/1976 | Schidlowski et al. | |
| 4,155,445 | A | * | 5/1979 | Roccaforte | 206/783 |
| 4,213,559 | A | | 7/1980 | Meyers | |
| 4,757,937 | A | | 7/1988 | Maio et al. | |
| 4,795,029 | A | | 1/1989 | Campbell et al. | |
| 4,955,528 | A | | 9/1990 | Schluckebier | |
| D317,102 | S | | 5/1991 | Clark et al. | |

(Continued)

FOREIGN PATENT DOCUMENTS

| | | |
|---|---|---|
| FR | 2759062 | 2/1979 |

(Continued)

*Primary Examiner*—Tri M Mai
(74) *Attorney, Agent, or Firm*—Wolf, Greenfield & Sacks, P.C.

(57) ABSTRACT

A shoe box having one or more integrally formed dividers extending from the end of the shoe box, with the dividers shaped and sized to extend laterally across and to be positioned between a pair of shoes within the box to secure the shoes in fixed space relation to one another. In one embodiment, one divider is integrally formed from the shoe box blank extending from one end of the box with a separate, removable insert divider having a similar function at the other end of the box.

5 Claims, 3 Drawing Sheets

U.S. PATENT DOCUMENTS

| | | | | |
|---|---|---|---|---|
| 5,193,671 | A | 3/1993 | Patterson | |
| 5,348,218 | A * | 9/1994 | Haire et al. | 229/117.07 |
| 5,590,766 | A | 1/1997 | Carnahan et al. | |
| 6,644,472 | B2 | 11/2003 | Coppedge et al. | |

FOREIGN PATENT DOCUMENTS

| | | |
|---|---|---|
| GB | 2055762 | 3/1981 |
| JP | 1-267151 | 10/1989 |

* cited by examiner

SHOE BOX DIVIDER

RELATED APPLICATIONS

This application is a continuation of U.S. application Ser. No. 10/131,313, entitled "SHOE BOX DIVIDER," filed on Apr. 24, 2002, which is herein incorporated by reference in its entirety.

FIELD OF INVENTION

The present invention relates to shoe boxes and, in particular, to a shoe box having means for maintaining each of a pair of shoes in fixed spaced relation to another within the box.

DESCRIPTION OF PRIOR ART

Shoe boxes have been designed for storing a pair of shoes in fixed spaced relation to one another. However, these prior designs have a variety of limitations which the present invention overcomes.

The Cahill U.S. Pat. No. 1,700,432 discloses a shoe carton in which a divider extends longitudinally along the length of the box separating it into upper and lower triangular cross-sections with each triangular cross-sectioned space designed to receive a shoe. The design requires a costly carton with a significant amount of extra material, provides limited space, and further limits the type of footwear that may be stored.

The Ferrago U.S. Pat. No. 1,764,251 discloses an unconventionally shaped trapezoidal cross-sectioned box which is difficult to make and impractical to store and to use in today's commercial world. The box, moreover, does not effectively separate the shoes of a pair of shoes contained in it since they are in physical contact and susceptible of rubbing against each other.

The Barnes U.S. Pat. No. 1,781,624 discloses a box in which shoes are positioned side by side with a length-wise extending divider. This box is designed as a more permanent display box and not for use in shipping shoes from a manufacturing facility to a retail facility. It is also difficult and costly to make.

The Brinnan U.S. Pat. No. 2,104,828 discloses a shoebox with a divider that extends the length of the box. This divider requires significant additional material with special handling and assembly. Further the box does not facilitate the display of the shoes within the box when it is opened.

The Mann U.S. Pat. No. 2,129,501 discloses a shoe box that requires a separate paste-board insert which divides the shoes longitudinally, and thus requires a significant use of additional materials for purposes of separating the shoes one from the other. The design disclosed is, moreover, complex, difficult to manufacture, and assemble which makes its use as a low cost package for shipping shoes impractical.

The Justin U.S. Pat. No. 2,709,518 discloses a package designed specifically for cowboy boots in which a specially die-cut spacer is provided to fit the boots. This arrangement is time consuming and expensive to assemble and is not readily adapted for a variety of different footwear.

The Carr U.S. Pat. No. 2,782,978 discloses a complicated shoe box design in which a divider is formed, in part, of multiple, longitudinally extending flaps that fold inwardly. The box does not appear to be capable of being mass produced and cannot be made at costs consistent with today's competitive requirements.

The Lee U.S. Pat. No. 2,834,460 discloses a collapsible shoe box with dividers that separate the box into compartments. One embodiment of this disclosure relies upon wrapping one shoe in tissue paper to prevent scuffing. A second embodiment illustrated in FIG. 8 uses a longitudinally extending internal divider similar in general to dividers previously discussed which extend from one end of the box to the other and which require significant additional cardboard or pasteboard and involve additional assembly problems.

The Aull U.S. Pat. No. 2,855,096 primarily features a box which opens at one end and has a mechanism formed integrally with a box for pulling the shoes by the heel from the box as the end is opened. The box has an integrally formed cover with a lip that engages a heel and as the box cover is pivoted open. The lip engages the heel and pulls it outwardly as the cover opens. It also has a divider extending from an end wall that separates one shoe from the other. The divider extends vertically to loosely separate the shoes. It does not provide a wedging action to support the shoes in fixed spaced relation. Nor is it adopted for universal use with footwear that have heels, as well as footwear that have no heels. Additionally, it is a complex design involving use of a great deal of material which is inconsistent with today's cost requirements.

The Johnson U.S. Pat. No. 3,360,112 discloses a shoe box in which an abutment extends across the bottom of the box for purposes of engaging a shoe heel. The purpose of this is to facilitate the opening of the box for sliding the shoes in and out. It is not primarily directed to a shoe box in which the individual shoes are maintained in fixed, separate relation one to the other since the design permits shoes of a pair to rub against each other.

The Patterson U.S. Pat. No. 5,193,671 attempts to resolve the problem of shoes rubbing one against the other by providing a pair of boxes that are integrally associated with one another. It does not deal with modifications of conventionally and commercially designed shoe boxes ordinarily used today to solve this problem. The solution suggested by Patterson is not a practical solution for mass produced commercial shoes.

The Carnahan U.S. Pat. No. 5,590,766 relates primarily to a permanent type of shoe box made of transparent plastic. It suggests the use of an integrally formed shoe tree that apparently support individual shoes. It does not deal with the conventional paperboard or cardboard boxes commercially available and ordinarily used today. Nor does it provide a suggestion for improving the function of these shoeboxes to maintain shoes separate one from the other.

These prior art shoeboxes, designed to hold a pair of shoes in fixed or spaced relation one to the other so that they would not rub against each other, particularly during shipping do, therefore, not solve a number of the concerns of shoemakers, dealers, and handlers of footwear. Since shoes can be easily marred or otherwise damaged by rubbing, it is important to keep them separate one from the other. Marring or scuffing of shoes while in transit does, of course, lessen the value and frequently makes the shoes unsaleable. These past efforts to provide a satisfactory solution, however, has not been altogether satisfactory for a variety of reasons in part referred to above.

SUMMARY OF THE PRESENT INVENTION

The present invention is a commercial shoe box made from conventional shoe box material such as cardboard or pasteboard with a sheet of cardboard die cut and scored in a manner that permits immediate and rapid assembly of the box in a production line, in such a manner as to readily receive pairs of shoes or other footwear, with the individual shoes spaced one from the other so as to prevent scuffing during transport of the shoes.

The present invention provides an inexpensive, easily manufactured and assembled shoe box having an integrally formed divider which separates the shoes one from the other while the shoes are being transferred or stored in the box.

A further object and advantage of the present invention is to provide a shoe box blank which may be inexpensively mass produced for assembly on site at the time the shoes are manufactured and ready for shipping.

A further object of the present invention is to provide an improved shoe box design in which the individual shoes of a pair may be readily displayed at a point of sale in a manner which will permit handling the box without the likelihood of the shoes scuffing one against the other.

The present invention is further designed to allow shipment of a wide range of footwear such as shoes, sandals, and the like in a manner that prevents them from being rubbed one against the other.

A further object and advantage of the present invention is to provide an efficient means for packaging shoes in a manner which eliminates the use of shipping paper. Heretofore shoes are frequently shipped in boxes and are secured in position by stuffing paper in the box. Not only is stuffing paper in the box expensive because of the cost of the paper, but the paper must be removed before the shoes are displayed at a retail establishment. The present invention eliminates the need for stuffing paper and permits the display of the shoes without the need of additional packaging material.

Further novel features and other objects of the present invention will become apparent from a consideration of the following detailed description and claims when taken in conjunction with the drawings.

DETAILED DESCRIPTION OF THE PREFERRED EMBODIMENTS

Although the specific embodiments of the present invention will be described with reference to the drawings, it should be understood that such embodiments are by way of example only and merely illustrative of but a small number of the many possible specific embodiments which may represent applications on the principles of the present invention disclosed herein. Various changes and modifications obvious to one skilled in the art to which the present invention pertains are deemed to be within the spirit scope of contemplation of the present invention as further defined and limited only by the appended claims.

Figure 1:
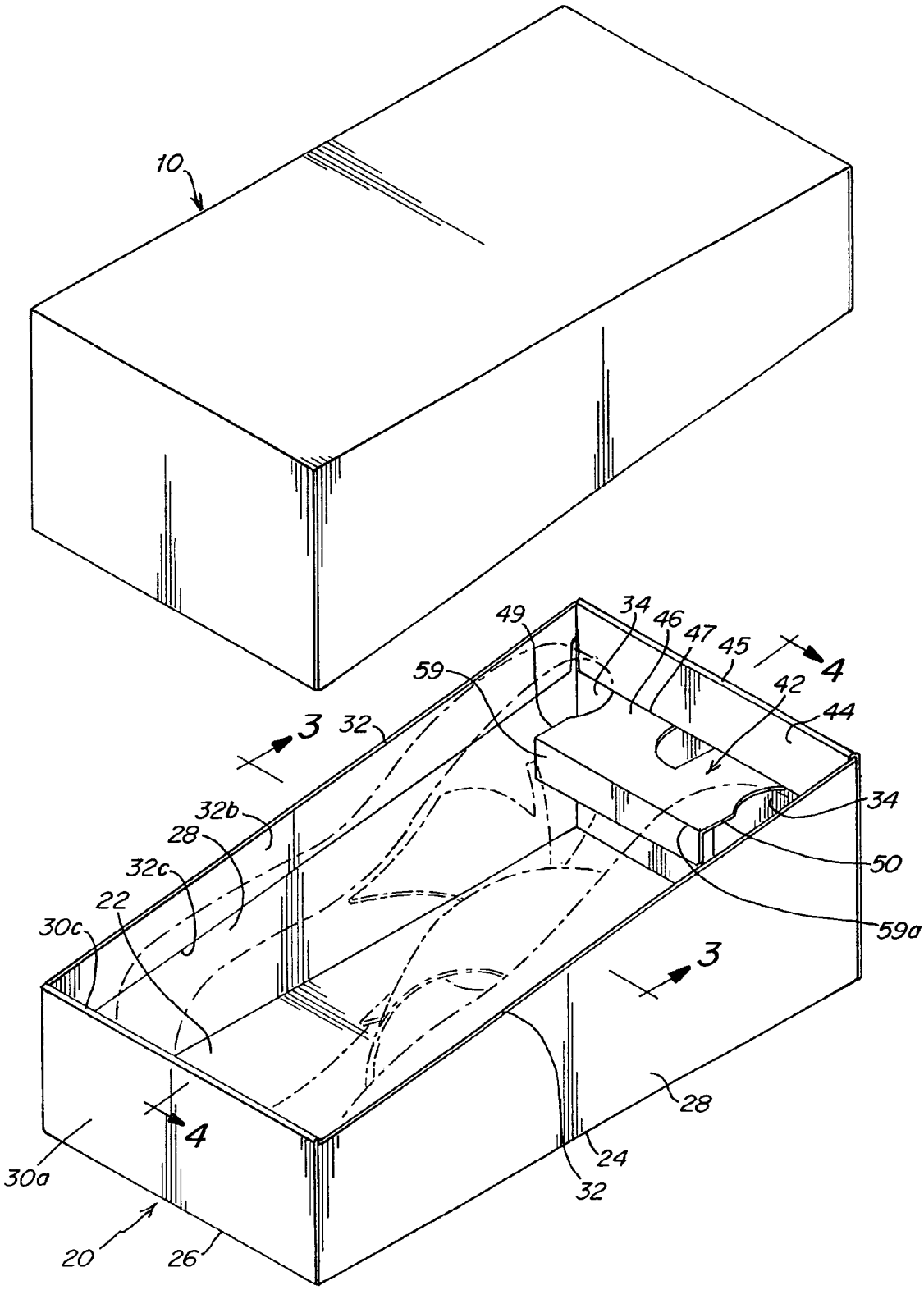
FIG. 1 is a perspective view of a shoe box with the top and bottom separated one from the other.

The shoebox illustrated in FIG. 1 includes a cover 10 and bottom 20. The cover 10 may be formed in a conventional fashion from cardboard or paperboard or other material conventional or suitably used for shoebox manufacture. The cover should be sized and shaped to fit over and closely engage all four sides of the bottom 20 as hereafter described. The bottom 20 may be formed from a conventional material such as paperboard or cardboard of a single piece of material die cut and scored as hereafter described. The bottom is formed with a bottom wall 22 defined by score lines 24*a*, 26*a* that form the edges of the bottom. Score lines 24*a* extend length-wise of the bottom to define side edges 24 (see FIG. 1). The ends of the bottom wall 22 are defined by score lines 26*a* which, in turn, form the end edges 26 at either end of the box when assembled. The score lines 24*a* define the bottom wall 22 from parallel side walls 28 while end score lines 26*a* define the bottom wall from parallel end walls 30*a*.

Figure 2:
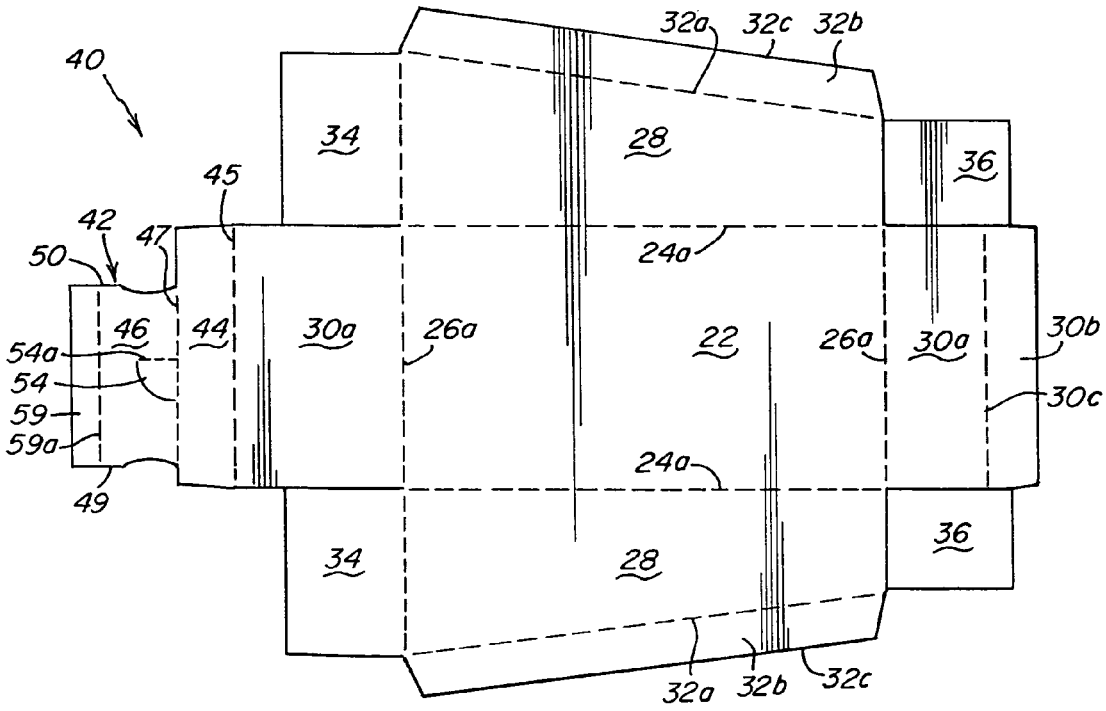
FIG. 2 is a plan view of a die cut blank from which the bottom half of the shoe box is formed.
Figure 3:
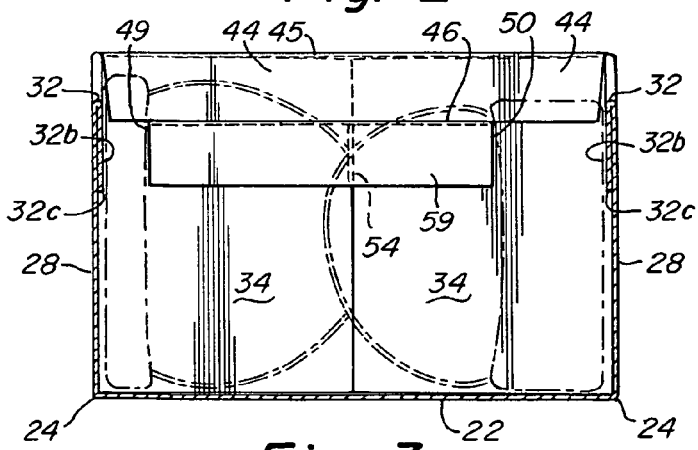
FIG. 3 is a cross-sectional view taken along the line 3-3 of FIG. 1.
Figure 4:
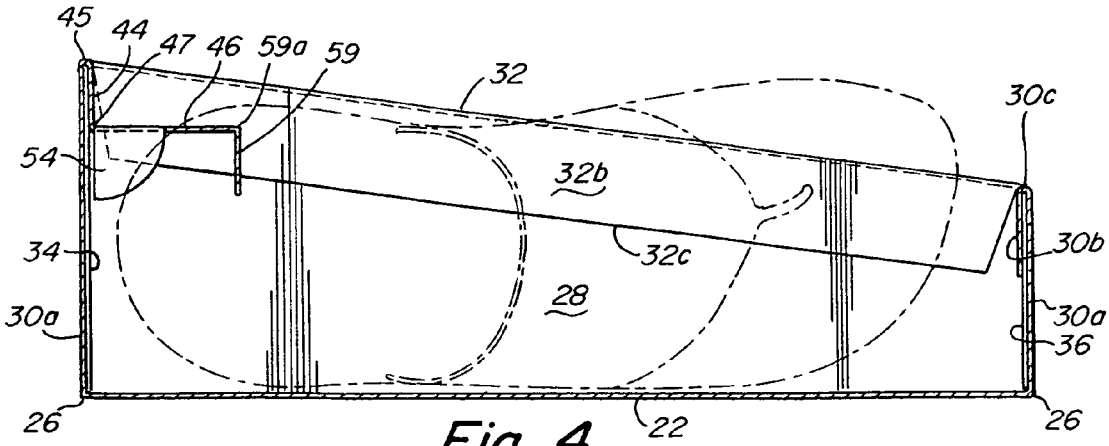
FIG. 4 is a cross-sectional view taken along the line 4-4 of FIG. 1.

As shown in FIG. 2, the panels forming the parallel side walls 28 are cut with a trapezoidal shape along edges 32*c* which extend between the score lines 26*a* defining one end wall and the score lines 26*a* defining the other end wall. Wide flaps 34 are formed at one end of the parallel side walls 28 while narrow flaps 36 are formed at the other end of parallel side walls 28. The end wall 30*a* at the wider end 40 extends beyond the ends of flaps 34 and is integrally formed with a divider 42. The divider 42 is formed with two panels, including an inner panel 44 separated from the end wall 30*a* by score line 45 and in turn the inner panel 44 is separated from the outer panel 46 by score line 47. The side edges 49 and 50 of the divider 42 are spaced closer together than the side edges that form the parallel end walls 30*a*. These side edges 49 and 50 may vary in shape depending upon the particular size and style footwear that is intended to be packaged in the box. Also provided in the divider 42 is a die cut flap 54 having a quarter round shape with the flap hinged along its straight edge 54*a*.

The outer side of the box may be finished in a conventional fashion. For example, the outer side may be suitably printed in color and designs If the outer side is finished and the inner surface is not, the edges of blank box may be finished. In such a finished box, flaps 32*b*, formed on the sidewall edges 32*c*, may be folded over at score lines 32*a* to form finished edges 32. Similarly, flap 30*b* may be formed at the end edge 30*c* so that the shorter end of the box will also have a finished appearance when finished.

In a preferred embodiment, one of the surfaces are printed to form a finished outer appearance of the box. The other, may as is conventional, be unprinted and have a raw, paper box appearance. Thus, when assembled, the box will have a finished colored or coated surface extending along the bottom sides and over the top, with the coated edges 32, 30*c* formed by the flaps 32*b* and 30*b*.

When box blank is assembled into a box, the sidewalls 28 are bent upwardly along the score lines 24*a*. Similarly, the end walls 30*a* are bent upwardly along the score lines 26*a*. The narrow flaps 36 are bent inwardly along the score lines 26*a* and the flap 30*b* is folded down over the narrow flaps 36, with this assembly suitably secured in a conventional fashion by suitable adhesive means. Similarly, at the other end, the wide flaps 34 are folded inwardly with their outer surface facing and engaging the inner surface of the end wall 30*a*. These facing surfaces are then secured together when the inner panel 44 is folded down into contact with the inner surfaces of wide flaps 34. A suitable adhesive on the inner surfaces of wide flaps 34 and the outer surface of inner panel 44 interengage and secure the box in an upright-formed assembly best illustrated in FIG. 1. The outer surface of the inner panel 44 as illustrated in FIG. 1 may be suitably finished with a coating or surface consistent with the outer surface of the sidewall's bottom and flaps 32*b* and 30*b* to present a finished appearance with the finished edges 24 and 26 and 32.

The integrally formed outer panel is reversely bent along the score line 47 to project inwardly as illustrated in FIG. 1. The end flap 59 which is defined from the outer panel 46 by score line 59*a* is folded downwardly. The angles of the fold along score lines 47 and 59*a* may be adjusted to accommodate the particular footwear inserted in the shoe box. As previously noted, the side edges 49 of the divider may be selectively shaped to accommodate the particular footwear for which the box is used. The divider is spaced from the adjacent side walls a distance sufficient to secure and receive a portion of a shoe. A distance in the order of magnitude of an inch is an acceptable space. In the embodiment of FIG. 1, the side edges 50 are shaped to engage the fore portions of a pair of sandals. In the event the box were to be used with dividers at both ends as hereinafter described, the side edges 49 may be shaped and spaced differently at each end to accommodate the different shapes of the ends of the shoes contained in the box.

The box illustrated in FIG. 1 is designed with a divider at one end only. While such an arrangement may be satisfactory under certain circumstances, the invention contemplates using integrally formed dividers at one or both ends of the box. It also contemplates arrangements, as hereafter described, in which the box has a divider integrally formed as part of the box blank at one end with a separate removable divider at the other end. The invention further contemplates boxes having side walls of shapes other than the trapezoidal shape illustrated in FIG. 1. The specific use of a box with a trapezoidal shape enhances the display function of the box permitting a potential purchaser to more readily observe the merchandise and further to more readily remove the merchandise for use.

Figure 6:
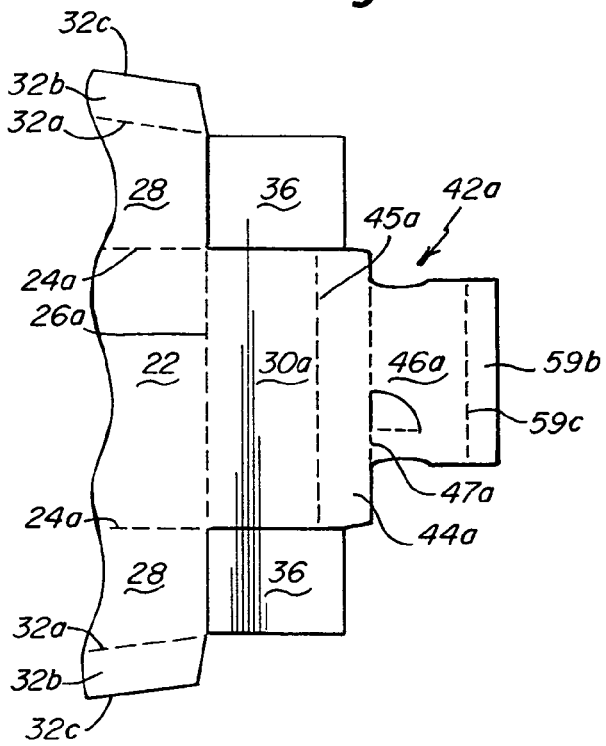
FIG. 6 is a modification of the present invention in which a second divider at the other end of the box is integrally formed with the box blank.

In a further modification of the present invention best illustrated in FIG. 6, the wide end of the die cut blank is similar to the blank of FIG. 2. Thus, the portions not shown in FIG. 6 are similar in construction to the portions illustrated in FIG. 2. In FIG. 6, like numerals refer to like components as those used to describe FIG. 2. A divider 42*a* is integrally formed with the box blank and extends from score line 45*a* which defines the end wall 30*a* from an inner panel 44*a*. An outer panel 46*a* extends from the score line 47*a*. The outer panel 46*a* is formed with an outer flap 59*b* which is defined from the outer panel 46*a* by score line 59*c*. This divider 42*a* functions and is formed in a manner similar to a divider 42 except that it is smaller in overall configuration. The divider 42*a* may be sized to engage the heel ends of the shoes and therefore has a narrower width than the divider 42 which may be shaped and sized to engage the toes of the shoes which when positioned in the box are normally spaced further apart than the heels. This is in contrast to an embodiment in which the footwear is inserted in the shoe in toe to heel relation, such as shown in FIG. 1.

Figure 5:
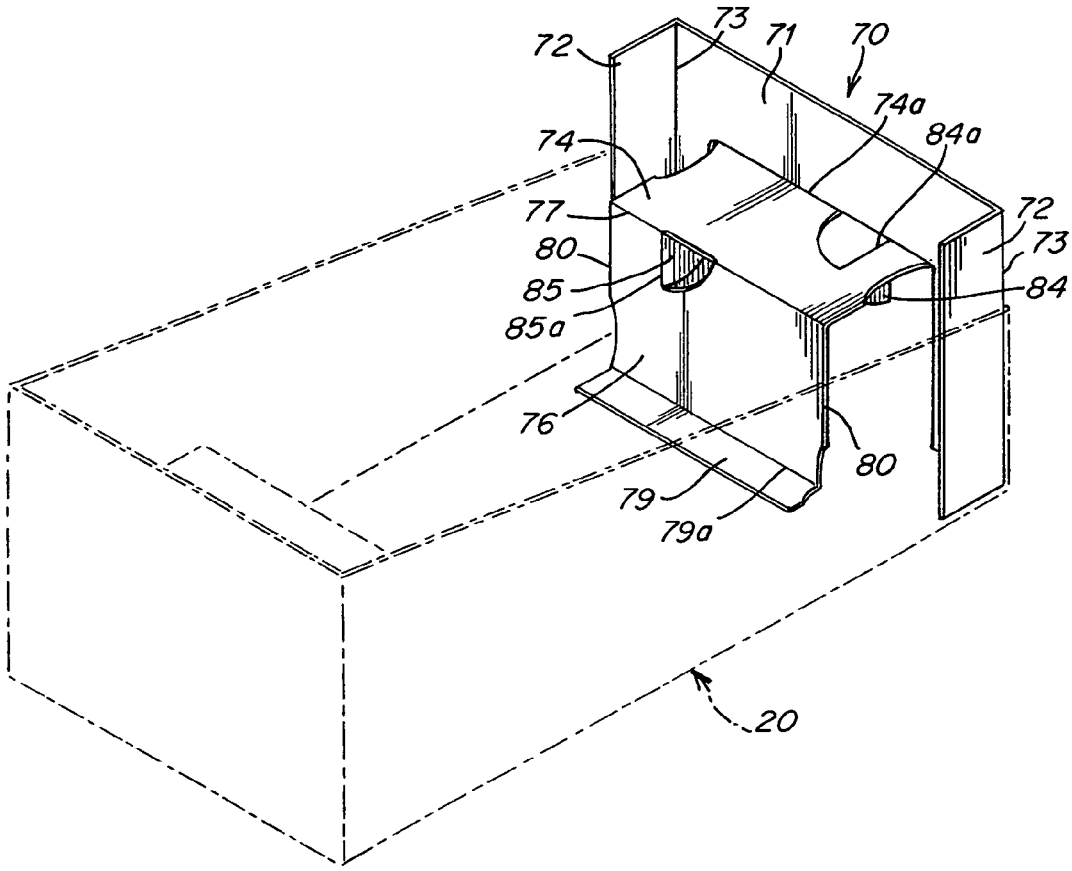
FIG. 5 is a perspective view of a removable insert for use in a modification of the invention.

The present invention further contemplates the use of an integrally formed divider such as illustrated in FIGS. 1 and 2 at one end of the box, and a removable divider at the other. In the embodiment of the type shown in FIG. 1, an integrally formed divider is formed at the wider end of the box while a removable divider (not shown in FIG. 1) is inserted at the narrower end of the box. The removable divider is illustrated in FIG. 5. This divider is preferred for use when the retailer believes there is not a substantial likelihood of scuffing shoes, once on display, but prefers an arrangement in which shoes may be more readily removed from the box, and may more readily be observed by a customer. By providing a removable divider at one end which is removed when the pair of shoes are put on display, a customer may easily reach in and remove one or both shoes and then return them to the box, which still provides a degree of separation and protection from scuffing of one shoe against the other.

The removable divider as illustrated in FIG. 5 consists of a die cut cardboard which may or may not be finished and which may or may not have suitable advertising or other printing associated with it. This die cut separable insert divider is formed with wall 71 and end flaps 72 that are folded at an angle of ninety degrees to the wall 71 along score lines 73. The wall 71 has a width essentially the width of the interior of the box and a height that would extend upwardly over the upper edge of the box 32 (the embodiment of FIG. 2) at the narrow end, but a distance sufficiently low enough to permit the cover 10 to close over the box in its entirety without interference from the height of the removable divider. For this purpose, the cover 10 may have a height sufficiently longer than the difference in the heights of the box at each end. In a preferred embodiment, the box may be formed with a cover 10 that has trapezoidal sides similar in shape and preferably approximately equal in side to the trapezoidal shape of the side walls 28. Thus, by using a box cover and base which are similar in size and shape, some economies of manufacture may be effected. In addition, the trapezoidal shape of the box provides a further interesting consumer attraction. By assembling the box and cover with the narrow end of the box aligned with the wide end of the cover, the box when shipped will assume a conventional, rectangular shape consistent with conventional shoe boxes.

The separable insert divider 70 is formed with an inner panel 74 defined from the wall 71 by score line 74*a*. An outer panel 76 is defined from the inner panel 74 by score line 77, while an outer flap 79 is defined from the outer panel 76 by score line 79*a*. The side edges 80 of the inner panel 74 and outer panel 76 and outer flap 79 are spaced a distance apart selectively determined by the particular shoes and box for which the divider is designed, but, in any event are spaced inwardly from the outer edges of the wall 71. A pair of tabs 84 and 85 are formed respectively in the inner panel 74 and outer panel 76. Each of these tabs have a quarter round radius and are hinged along one edge extending normally from the score lines 84*a* and 85*a* respectively. These tabs function to hold the flaps in position.

The separate insert divider 70 is shaped and sized for easy installation into the end of the shoe box and is provided with panels 74 and 76 sufficiently wide to extend between the particular pair of shoes being inserted. It is preferable this divider be dimensioned to snuggly engage the shoes. For example, in the event a pair of sandals are being secured, the inner and outer panels are sized and shaped to frictionally engage the heels of the sandals. Since the divider is made of a soft paperboard or cardboard, the inter-engagement of the panel with the sandals will not mar or scuff the shoes, but nonetheless will hold it in a firm, fixed relationship to one another and within the shoe box. Additionally the panels may be bent to accommodate variations from shoe to shoe.

The present invention is not intended to be restricted to any particular form or arrangement or any specific embodiment disclosed herein or any specific use since the invention may be modified in various particulars or in relations without departing from the spirit or scope of the enclosed invention which is shown and described and in which the disclosed embodiments offer illustrative purposes and for disclosure of an operative embodiment of the invention and are not intended to show all forms of the invention or modifications in which the present invention might be embodied or operated.

Having now described my invention, I claim:

1. A shoe box having parallel side walls and a pair of shoes positioned therein with the soles of the shoes facing outwardly and respectively one to each of said parallel side walls, said box formed of a single box blank also having end walls and a box bottom, said blank also having a divider extending from one end wall, said divider shaped and sized to be folded inwardly into the formed box bottom with panels defining the divider in part extending laterally across a fraction of the width of the box bottom, wherein said divider is integrally formed with the box blank, and wherein said divider is sized and shaped to hold said pair of shoes within the shoe box with the soles of the shoes facing outwardly toward and adjacent the side walls, and with the divider lying at least in part in a plane substantially parallel to the bottom of the shoe box, and with at least a panel of the divider adapted to contact and separate said pair of shoes.

2. A shoe box as set forth in claim 1 wherein the divider is sized and shaped to hold the toe portion of one shoe and the heel portion of the other shoe.

3. A shoe box as set forth in claim 1 wherein the divider is sized and shaped to engage facing portions of the uppers of a pair of shoes.

4. A shoe box as set forth in claim 1 wherein each side edge of the divider is non-linear.

5. A shoe box as set forth in claim 1 wherein an end flap of the divider extends essentially orthogonally from the panel of the divider adapted to separate said pair of shoes.

* * * * *